United States Patent [19]

Poiry

[11] 4,187,661

[45] Feb. 12, 1980

[54] BUILDING SIDING REMOVAL AND REINSTALLATION SYSTEM

[76] Inventor: William R. Poiry, 5306 N. State Rt. 590, Oak Harbor, Ohio 43449

[21] Appl. No.: 855,428

[22] Filed: Nov. 28, 1977

[51] Int. Cl.[2] ..... E04G 23/00

[52] U.S. Cl. ..... 52/748; 52/514; 52/551

[58] Field of Search ..... 52/514, 551, 741, 748, 52/529, 530, 531

[56] References Cited

U.S. PATENT DOCUMENTS

| | | | |
|---|---|---|---|
| 1,121,365 | 12/1914 | Hull | 52/514 |
| 1,318,125 | 10/1919 | Zimbelmann | 52/514 |
| 2,766,861 | 10/1956 | Abramsom | 52/531 |
| 3,108,405 | 10/1963 | Charles | 52/531 |
| 3,218,772 | 11/1965 | Martin | 52/529 |
| 3,325,952 | 6/1967 | Trachtenberg | 52/514 |

*Primary Examiner*—James A. Leppink
*Assistant Examiner*—Henry E. Raduazo
*Attorney, Agent, or Firm*—Wilson, Fraser, Barker & Clemens

[57] ABSTRACT

A method of removing and reinstalling metal siding on buildings. The method enables the removal of metal siding from buildings to thereby provide access for the drilling of holes for the injection therethrough of particulate insulation such as cellulosic material, for example, and then reinstalling the removed section of siding in such manner as to prevent a change in the overall exterior appearance of the building.

1 Claim, 7 Drawing Figures

BUILDING SIDING REMOVAL AND REINSTALLATION SYSTEM

BACKGROUND OF THE INVENTION

Previous attempts have been made to develop systems for the removal of sections of metal siding from buildings preparatory to the necessary drilling of the supporting wall structures to provide access to the zones between adjacent studs for the purpose of injecting a blown-in type insulation material. The majority of systems have required the reinsertion of a new section of siding because the original section was either damaged or there was no satisfactory method of fastening the original siding section in place without destroying the overall appearance. Manifestly, while the new section of siding may have been the same color as originally installed on the building being insulated, the new section was of a considerably different tonation and texture from the adjacent older sections of siding. Therefore, the new siding section was readily apparent in such situations. Due to the cosmetic change in the appearance of the building, many homeowners, have foregone the insulation of their homes when, due to energy shortages, they should have proceeded with the necessary insulating.

SUMMARY OF THE INVENTION

It is an object of the present invention to produce a method of removing a section of metal siding from a building preparatory to injecting blown-in insulation and replacing the removed siding after insulating without a noticeable change in the overall appearance of the building.

Another object of the invention is to produce a system for removing a section of metal siding from a building preparatory to injecting blown-in insulation in the zones between adjacent stud members and replacing the removed siding after insulating, without a noticeable change in the overall appearance of the building.

The above objects of the invention may be achieved by a method consisting of: uncoupling the lower overlapped edge of a first section of siding from a projecting portion of the upper marginal edge of a second section of siding to be removed; removing the upper marginal edge of the second section of siding from the associated building and from the main portion of the siding; uncoupling the lower overlapped edge of the second section of siding from the upper portion of a third section of siding immediately below the second section; securing a strip to the building to couple the lower marginal edge of the first section of siding; reinstalling the second section of siding by inserting the free severed upper edge portion thereof against the strip adjacent the bottom edge of the first section and coupling the bottom edge thereof with the upper edge of the third section of siding; and fastening the upper portion of the second section of siding to the strip.

BRIEF DESCRIPTION OF THE DRAWINGS

The above, as well as other objects and advantages of the invention will become readily apparent from reading the following detailed description of a preferred embodiment of the invention when considered in the light of the accompanying drawings, in which.

DETAILED DESCRIPTION OF AN EMBODIMENT OF THE INVENTION

Figure 1:
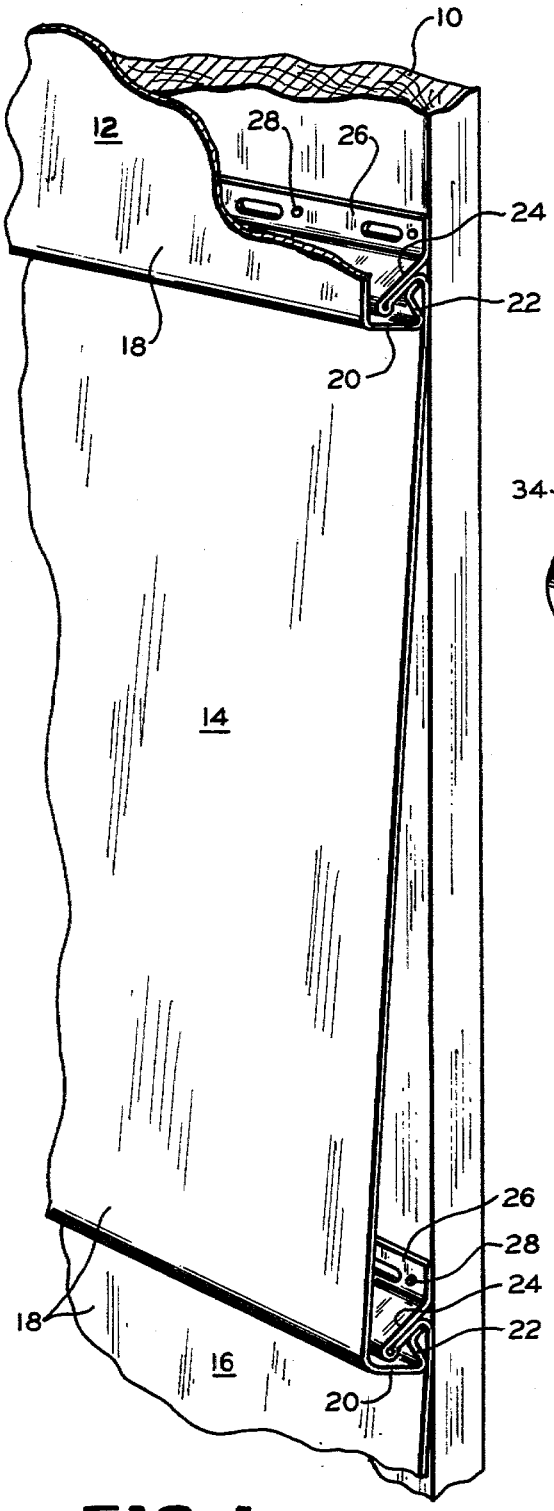
FIG. 1 is a fragmentary perspective view with portions broken away illustrating three adjacent sections of conventional metal siding of a building structure.

Referring to the drawings, and in particular to FIG. 1, there is illustrated a portion of a building structure including a sheathing 10 secured to the spaced apart vertically extending stud member (not shown). Typically, the sheathing 10 is formed of horizontally extending wooden members, composite panels, plywood panels, or the like which are nailed in place to the outer surfaces of the spaced stud members. Plaster lath or drywall panels are typically secured to the inner surfaces of the stud members to form the interior of a building.

In the present building techniques wherein the sheathing 10 is formed of panels of composite material, the outer surfaces thereof are impregnated or coated with a moisture resistant material such as an asphaltic material, for example. The exterior of the building is comprised of siding such as metal siding manufactured from steel or aluminum alloys which are formed from strip stock. In FIG. 1, three adjacent sections of metal siding are illustrated; namely, an upper section 12, an intermediate section 14, and a lower section 16. All of the siding sections are formed of substantially identical cross-sectional configuration such that the lower edge of one of the sections is configured to couple with the upper edge of the section immediately below to form a weather-tight seal therebetween. Since the configuration of the locking elements of the siding sections 12, 14, and 16 are identical, similar reference numerals will be used throughout the description. More specifically, each of the siding sections 12, 14, and 16 includes a main body portion comprised of an extended planar surface 18. The lower edge portions or butt ends of the siding sections are formed to include a lower horizontally disposed and inwardly extending segment 20 which terminates in an integral upwardly and inwardly curved sgement 22.

The cooperating upper edge portions of the siding sections include an outwardly slightly downwardly extending lip 24 formed by bending the metal of the siding upon itself as illustrated in FIGS. 1, 3, 4 and 7. The upper edges of the siding sections terminate in a segment 26 which is adapted to be positioned against the outer surface of the sheathing 10 and is secured thereto by suitable fasteners 28 such as nails, for example.

It will be observed that the lower edges of the siding sections are coupled to the upper edges of an immediately lower siding section to form a weather-tight seal between the adjacent sections. The weather-tight seals are accomplished in construction by initially securing a lower siding section, for example section 16 in place and fastening the same by driving nails 28 or other suitable fastening devices through suitable apertures in the upper edge portion. Then, the inwardly and upwardly curved segment 22 of the next higher siding section 14 is disposed under the inclined surface of the outwardly and downwardly inclined lip 24. The siding section 14 is then moved upwardly causing the segment 22 thereof to be cammed inwardly toward the sheathing 10 until the outer surface of the juncture between the horizontally disposed segment 20 and the upwardly and inwardly curved segment 22 abut the outer surface of the surface 18 of the siding section 16. At this point in the installation of the siding, the siding section 14 is secured in place by the fasteners 28. Manifestly, a weather-tight seal is thus achieved between the upper edge of the siding section 16 and the lower edge of the siding section 14. In a like manner, the siding section 12 is secured to the sheathing 10 to form a weather-tight seal between the upper portion of the siding section 14 and the lower portion of the siding section 12. The procedure, of course, is continued until the entire surface of the sheathing 10 is completely covered.

Now, in the instance where it is desired to insulate the building after the siding has been installed and in place for some time, it is necessary to typically remove two spaced apart sections of siding so that a series of holes may be formed in the sheathing to allow for the insertion of blown-in type insulation into the voids between adjacent stud members. Normally, at each particular zone between stud members, an upper and a spaced apart lower hole must be drilled for the introduction of the insulating material.

Figure 2:
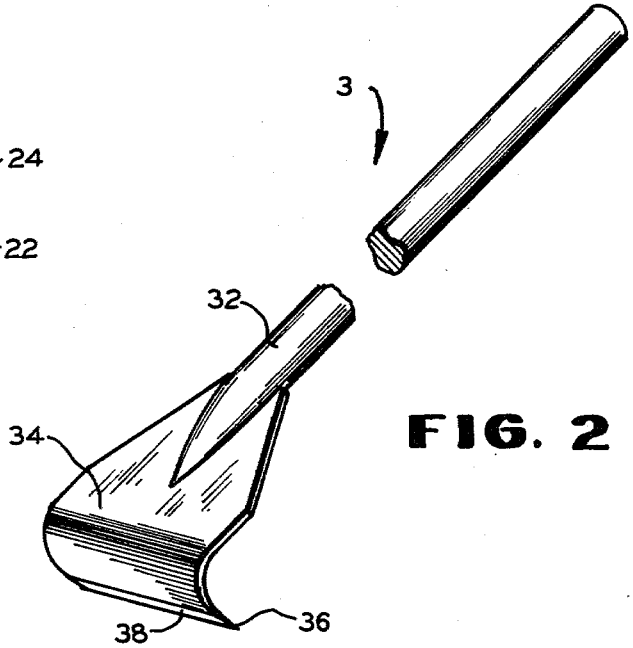
FIG. 2 is a perspective view of a tool used in the present invention.
Figure 3:
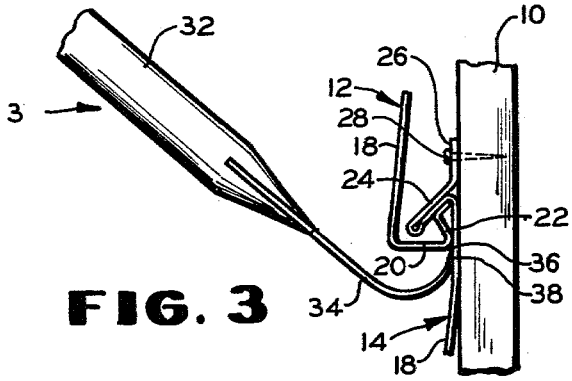
FIG. 3 is a fragmentary sectional view showing the tool illustrated in FIG. 2 being inserted between the coupled edges of two adjacent sections of siding illustrated in FIG. 1.

In accordance with the invention, the particular siding sections to be removed are selected and for purposes of explanation it will be assumed that it is desired to remove siding section 14. At this point, at tool 30 illustrated in FIG. 2 is inserted under the lower edge of the siding panel 12 as illustrated in FIG. 3. It will be observed that the tool 30 has a handle portion 32 and a curved bladelike tip portion 34. The curved tip portion 34, as will be seen in FIG. 2, is of considerably greater width than the handle portion 32. The inner and outer walls which define the curved tip portion terminate in a tapered knife-like edge 36. The knife-like edge 36 is preferably formed by the outer surface of the tip portion 34 converging toward the inner surface, thus a flat surface 38 is formed to initially contact the outer surface 18 of the siding section 14 when the removal operation is initiated. The blade or tip portion 34 of the tool 30 is typically formed of steel and is sufficiently strong to effectively cam the lower edge of the siding section 14 downwardly and outwardly to uncouple the same from the outwardly extending lip 24 on the upper edge of siding section 16 located immediately below.

In operation, the tool 30 is positioned in such a manner that the knife edge 36 of the tip 34 is directed upwardly. The edge 36 is then urged between the innermost end of the segment 20 of the lower edge of the siding section 12 as illustrated in FIG. 3. Next, the tip 34 is forced upwardly, the handle portion 32 is rocked downwardly causing the outer curved surface thereof to rock on the outer surface of the upper edge of siding section 14. As this rocking movement continues, the knife edge 36 and a portion of the inner surface of the tip 34 contact the outer surface of the upwardly and outwardly curved segment 22 and cams the same simultaneously outwardly and downwardly along the lower surface of the outwardly and downwardly inclined lip 24. The rocking movement of the tool 30 is continued until the uppermost edge of the segment 22 of the lower edge of the siding section 12 passes over the end of the lip 24 at which point the lower edge of the siding section 12 is effectively uncoupled from the upper edge of the adjacent lower siding section 14.

To effect a complete uncoupling of two adjacent siding sections, the above procedure must be followed at a number of spaced apart locations along the bottom edge of the section 12. As soon as the siding section 12 is completely uncoupled from the siding section 14, the nails 28 which secure the siding section 14 to the sheathing 10 are readily accessible and are removed. The siding section 14 is then free to be lowered, thereby enabling the uncoupling of the bottom edge thereof from the upper edge of the next lower siding section 16. The siding section 14 is now free and may be stored remotely of the building.

It will be apparent that since the sheathing 10 is now exposed, it may be drilled at suitable locations to provide access or communication with the interior zones between adjacent stud members for the admission or introduction of blown-in insulation, for example. Upon completion of the introduction of the desired quantity of insulation material, the holes drilled in the sheathing 10 are plugged, and the building is ready for the reinstallation of the removed siding.

Figure 5:
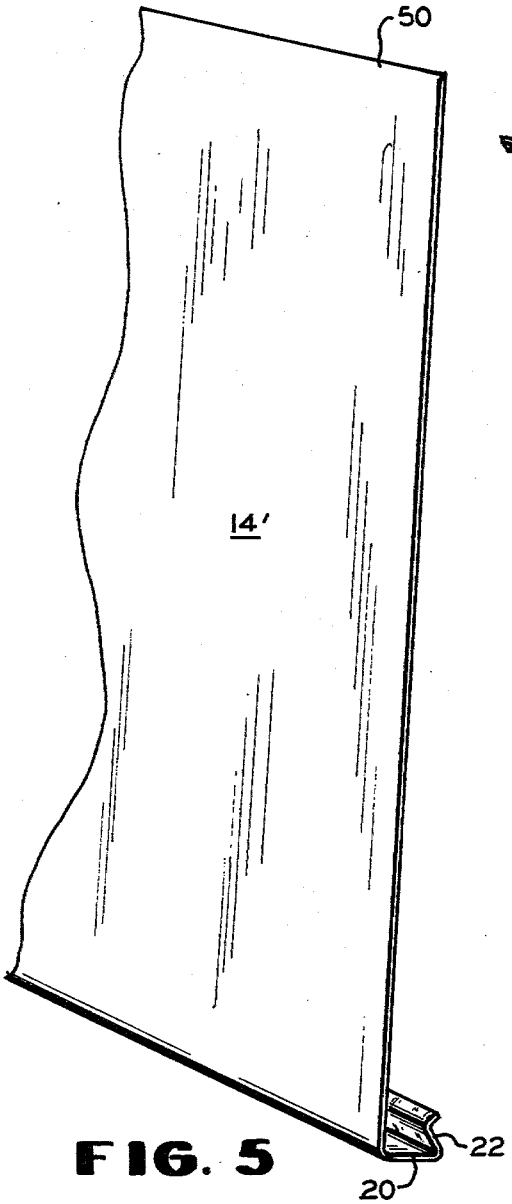
FIG. 5 is a fragmentary perspective view of a section of siding with the upper edge portion thereof removed.

At this point, the top or upper edge portion of the siding section 14 containing the outwardly and downwardly extending lip 24 is severed from the extended surface portion 18 as illustrated in FIG. 5. The altered siding section is indicated by reference numeral 14. The purpose for altering the original siding section 14 is to enable the use of the original section to the extent possible. In practice, it has been found nearly impossible to secure the upper edge of the siding section 14 to the sheathing without denting or in some fashion damaging the siding with deleterious cosmetic effects.

Figure 4:
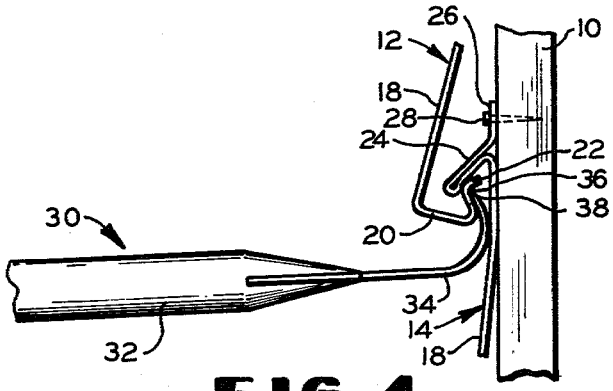
FIG. 4 is a fragmentary sectional view similar to FIG. 3 showing the tool being rocked to an intermediate position during the uncoupling of the upper edge portion of a section of siding to be removed from the lower edge of an adjacent upper section of siding.

The invention employs a novel strip 40 illustrated in FIG. 4 typically formed of metal which includes a flat section 42 having spaced nail receiving apertures 44, and a downwardly extending flange portion 46 which terminates in an upwardly curved edge portion 48. The strip 40 is disposed so that the section 42 is flush against the outer surface of the sheathing 10. The curved edge portion 48 of the strip 40 is effective to impart rigidity to the flange portion 46. While the strip 40 is preferably formed of a metal, it will be understood that other materials, such as plastic, can be used. In use, the undersurface of the flange portion 46 and the associated curved portion 48 are positioned within the interior of the channel formed by the inner surfaces of the lower end of the extended surface 18, the segment 20, and the inwardly curved segment 22 of the siding section 12. The angular relationship between the facing surfaces of the flat section 42 and the associated flange portion 46 is such that the inwardly curved segment 22 of the siding section 12 fits snuggly therebetween. It will be observed from an examination of FIG. 7, that the flat section 42 depends below the lower edge of the siding section 12 thereby exposing the nail hobs 44 permitting the insertion and driving of nails therein by a hammer, for example, without damaging the siding section 12.

Figure 7:
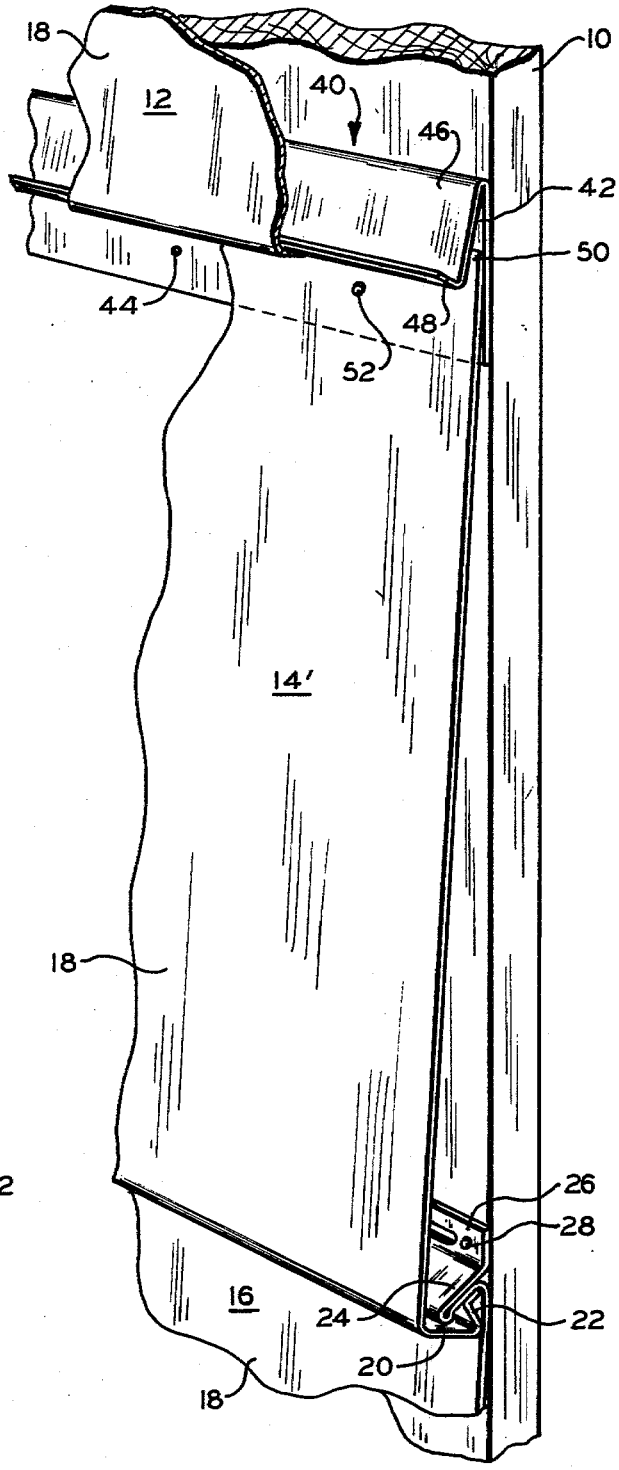
FIG. 7 is a fragmentary perspective view showing the fastening strip of FIG. 6 secured to the building sheathing and the removed section of siding illustrated in FIG. 5 reinstalled.
Figure 6:
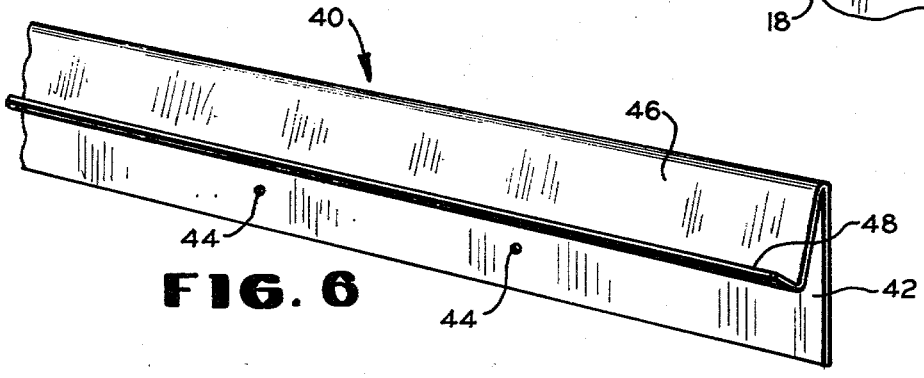
FIG. 6 is a fragmentary perspective view of a fastening strip in accordance with the invention.

After the strip 40 has been fastened in place, the severed upper edge 50 of the siding section 14' is inserted between outer surface of the flat section 42 of the strip 40 and the inner surface of the juncture of the horizontal segment 20 and the upwardly and inwardly curved terminal portion 22 of the lower edge of the siding section 12. Simultaneously, the bottom portion of the siding section 14' is caused to allow the outwardly and downwardly projecting lip 24 of the upper edge of the siding section 16 to be cammed inwardly as illustrated in FIG. 7. Since the upper marginal edge portion of the siding section 14 has been removed the upper edge of the altered section 14' does not have substantial strength and resistance to bending or wrinkling. However, the spring action or tension of the flange portion 46 of the strip 40 functions to maintain the extended surface 18 of the siding section 14' free from wrinkles even during rather severe temperature variations which might otherwise tend to buckle the metal by uneven expansion and contraction thereof.

When the siding section 14' is in place, suitable fasteners such as rivots 52, for example, may be inserted to effect a fastening between the upper edge of the siding section 14' and the flat section 42 of the strip 40. To minimize any deformation of the metal of the siding section 14', it is considered desirable to initially drill holes in the upper edge thereof preparatory to the insertion of the rivots. Also, it is considered to be desirable to dispose the holes for the rivots 52 in the "shadow zone" immediately below the bottom most edge of the siding section 12 so as to be less visible.

In accordance with the provisions of the patent statutes, I have explained the principle and mode of operation of my invention and have illustrated and described what I now consider to represent its best embodiment. However, it must be understood that within the spirit and scope of the appended claims, the invention may be practiced otherwise than as specifically illustrated and described.

What I claim is:

1. A method of removing and reinstalling building siding comprising the steps of:

uncoupling the lower overlapped edge of a first section of siding from the upper marginal edge of a second section of siding to be removed;

removing the upper marginal edge of said second section of siding from the associated building;

uncoupling the lower overlapped edge of said second section of siding from the upper portion of a third section of siding immediately below said second section;

securing a strip to the building to couple the lower marginal edge of said first section of siding;

severing the upper marginal edge of said second section from the main portion of said second section of siding;

reinstalling said second section of siding by placing the free severed upper edge portion thereof against at least a portion of the said strip adjacent the bottom edge of said first section of siding and coupling the bottom edge thereof with the upper edge of said third section of siding; and fastening the upper portion of said second section of siding to said strip.

* * * * *